US012480299B2

(12) United States Patent
Modeste

(10) Patent No.: US 12,480,299 B2
(45) Date of Patent: Nov. 25, 2025

(54) TOILET VACUUM SYSTEM

(71) Applicant: Joseph Modeste, Graceville, FL (US)

(72) Inventor: Joseph Modeste, Graceville, FL (US)

( * ) Notice: Subject to any disclaimer, the term of this patent is extended or adjusted under 35 U.S.C. 154(b) by 299 days.

(21) Appl. No.: 18/315,956

(22) Filed: May 11, 2023

(65) Prior Publication Data

US 2023/0279652 A1 Sep. 7, 2023

Related U.S. Application Data

(63) Continuation-in-part of application No. PCT/US2021/072382, filed on Nov. 12, 2021, which is a continuation of application No. 16/974,195, filed on Nov. 12, 2020, now abandoned.

(51) Int. Cl.
*E03D 9/05* (2006.01)
*A47K 13/10* (2006.01)
*E03D 5/10* (2006.01)

(52) U.S. Cl.
CPC ..... *E03D 9/05* (2013.01); *A47K 13/10* (2013.01); *E03D 5/10* (2013.01)

(58) Field of Classification Search
CPC .... E03D 9/05; E03D 9/04; E03D 9/08; E03D 9/052; E03D 5/10; E03D 2201/20; E03D 11/13; E03D 11/135; E03D 11/18; A47K 13/10; A47K 13/307
USPC ..... 4/237, 242.1, 246.1
See application file for complete search history.

(56) References Cited

U.S. PATENT DOCUMENTS 4,094,023 A 6/1978 Smith
4,893,359 A 1/1990 Vu
5,603,127 A * 2/1997 Veal ..... E03D 5/10 4/313
7,380,292 B1 6/2008 Harris
8,555,427 B2 * 10/2013 Stauber ..... A47K 13/10 4/240
10,480,168 B1 * 11/2019 Cox ..... E03D 5/022
2006/0085901 A1 * 4/2006 Janssen ..... E03D 3/10 4/354
2015/0074893 A1 * 3/2015 Veros ..... E03D 1/00 4/406
2017/0198465 A1 * 7/2017 Crisp ..... E03D 11/13

FOREIGN PATENT DOCUMENTS

CN 2355012 Y 12/1999
GB 2143872 A * 2/1985 ..... A47K 13/307

* cited by examiner

*Primary Examiner* — David P Angwin
*Assistant Examiner* — Christopher S. Parisi

(57) ABSTRACT

A toilet vacuum system uses an opening in a toilet bowl that is communicably coupled with a vacuum pump through a first drainage tube to extract gases and odors from a toilet bowl. The vacuum pump may be communicably coupled with an opening in the toilet bowl to remove gases as they are created. The toilet seat may further have a gasket to help seal in gases and odors to allow gases to be removed from the toilet bowl without escaping. The gases may be expelled by the exhaust of the vacuum pump out of a second drainage tube into a disposal point. The first drainage pipe may further have a water trap to prevent gases from re-entering the toilet bowl. In some embodiments, the toilet vacuum system may further have an access panel with sound proofing to house the vacuum and electrical components. The opening and closing of the toilet lid may be automated through the use of motors.

18 Claims, 10 Drawing Sheets

TOILET VACUUM SYSTEM

FIELD OF THE INVENTION

The present invention relates generally to toilet sanitation system. More specifically, the present invention is a vacuum-based toilet sanitation system adapted to remove odors.

BACKGROUND OF THE INVENTION

Generally, the most difficult room in the house to clean and to maintain a pleasant smell in, is the bathroom. In particular, the main source of this problem comes from the toilet bowl itself. No matter how consciously aware people are about having to use the bathroom, the truth is, there's an on-going problem that continues to linger in the air, and this will always be a great source of embarrassment. Flushing the toilet only helps remove the excrement and fecal matter from the toilet bowl, yet the odor will remain. Other solutions—such as air fresheners—just mask the stench by over-saturating the air with a further stench of heavy fragrances and harsh perfumes that quickly fade with time. Nevertheless, if the problem is allowed to persist, then gases and odors may adhere to the walls of the bathroom, and may eventually adhere to the clothes and body of bathroom occupants, as well.

In order to solve this problem, the present invention incorporates a vacuum system and a tubing system together to remove and transfer the gases and foul odors from the toilet bowl and redirects these odors and gases directly into a sewer, septic system, or other disposal point. The vacuum is coupled to at least one vent placed beneath the toilet seat. The toilet seat may further comprise a gasket to help seal the edges of the seat and prevent odors from escaping. When the vacuum is activated, the vent sucks in air, removing the odors from the air in the toilet bowl, and transmitting those odors through a drainage pipe into the disposal point. In some embodiments, the present invention may further make use of automated features for the convenience of the user, such as momentary buttons adapted to activate the vacuum when a user sits on the toilet, a foot-activated button to raise and lower the toilet seat and lid, and a sound-proofed access panel to shield the sound of the vacuum pump and drainage system while allowing the user easy access to those components for quick and easy maintenance. These automated components may be controlled by a rechargeable battery and a relay or motherboard. The system may be adapted for use in either commercial or residential settings by changing the plumbing mechanism in different embodiments.

DETAIL DESCRIPTIONS OF THE INVENTION

Figure 1:
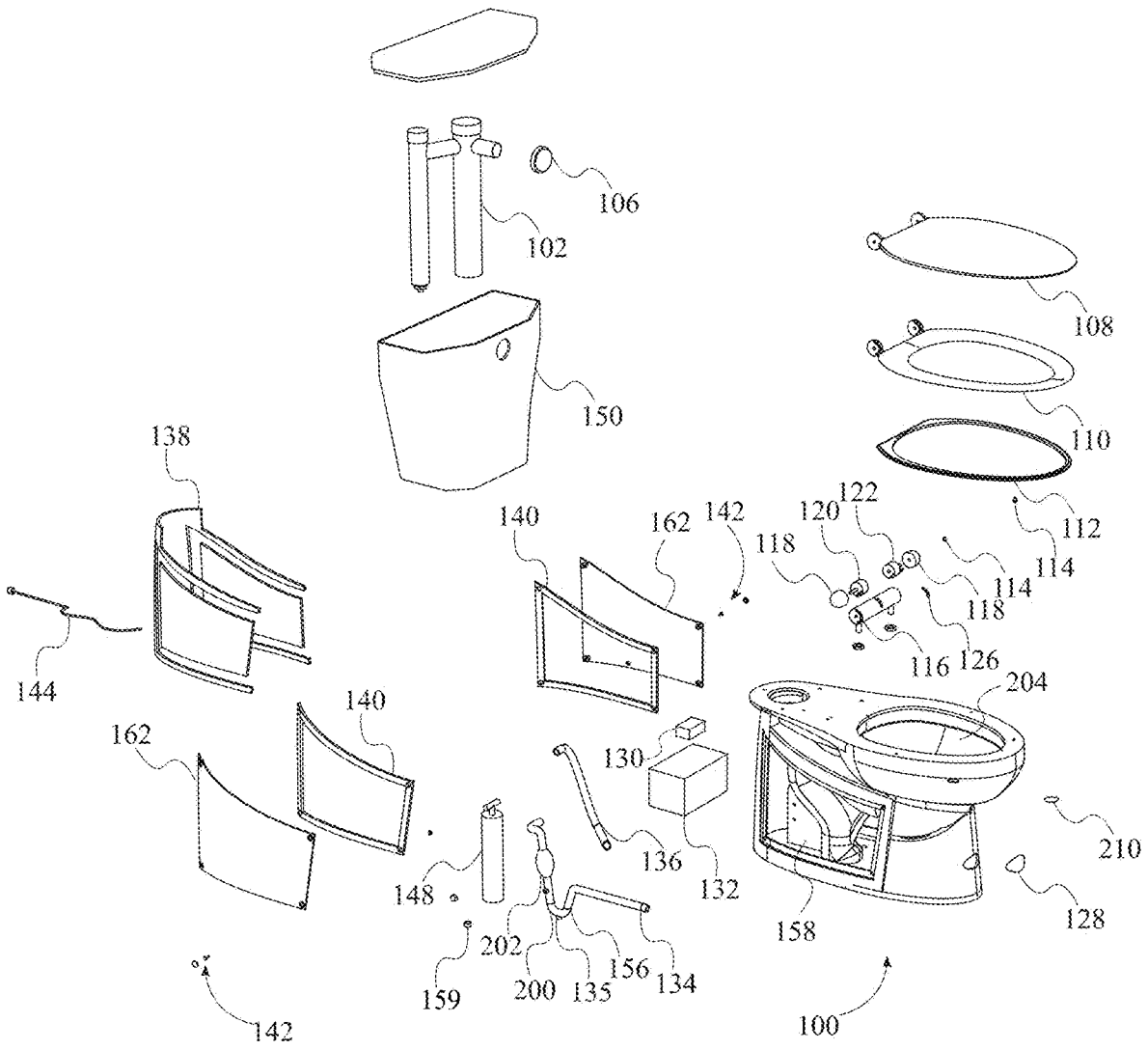
FIG. 1 shows an exploded perspective view of the present invention.

All illustrations of the drawings are for the purpose of describing selected versions of the present invention and are not intended to limit the scope of the present invention.

The present invention is a toilet vacuum system. Referring now to the figures, as seen in FIGS. 1-9, the toilet vacuum system may comprise a toilet 100, a plumbing assembly, a flush button 106, a toilet lid 108, a toilet seat 110, a seat gasket 112, at least one momentary button 114, a seat mechanism housing 116, a housing end cap 118, at least one motor assembly, a light lens 126, a lighted push button 128, a relay, a battery 132, a first drainage tube 134, a second drainage tube 136, an access area 158, a power cord 144; at least one bowl odor vent 208, a vacuum pump 148, a toilet tank 150, and at least one bowl refill vent 152. It should be noted that while this disclosure describes the toilet independently, the invention may be adapted to retrofit onto an existing toilet for broader applicability.

Figure 8:
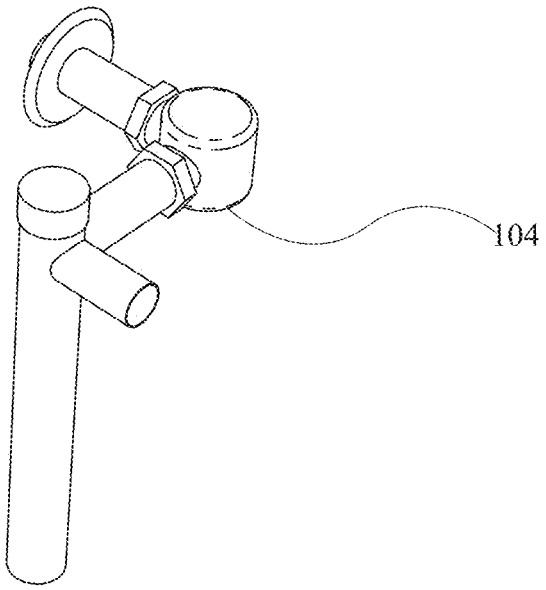
FIG. 8 shows an exemplary embodiment of the commercial plumbing assembly.
Figure 9:
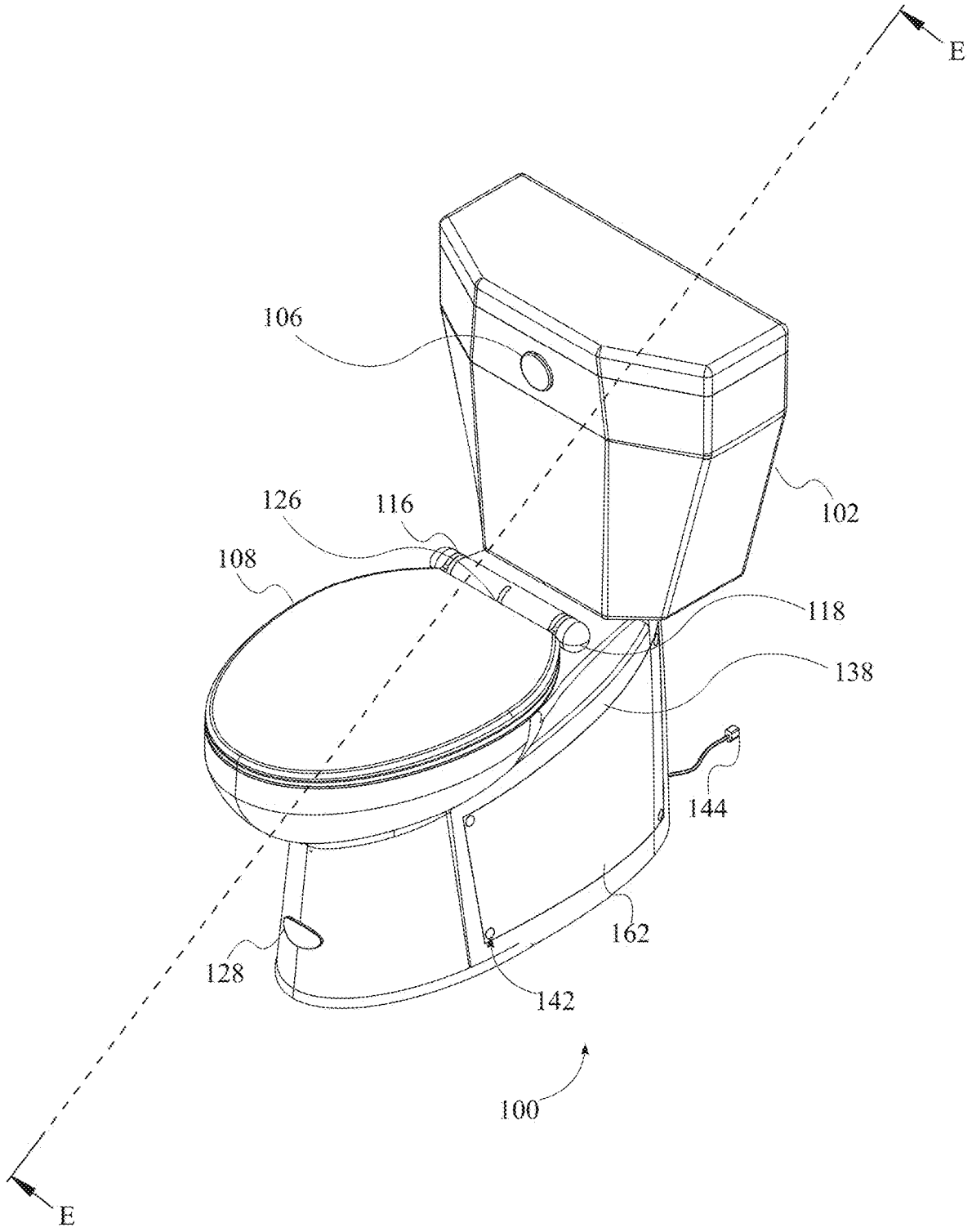
FIG. 9 shows a perspective view of the present invention.
Figure 10:
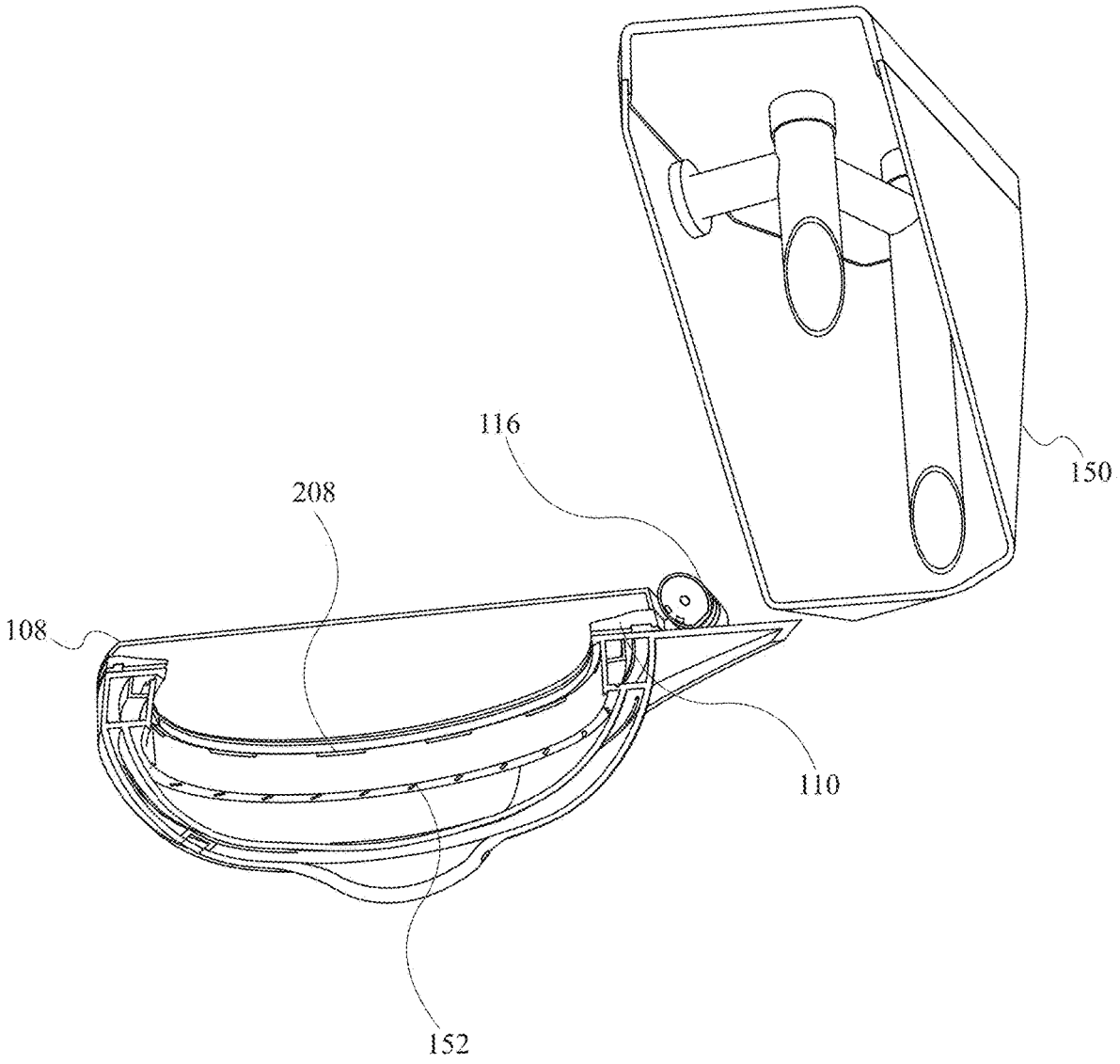
FIG. 10 shows a cross-sectional view of FIG. 9 taken along line E-E.

The invention comprises a toilet 100, as is well-known in the art. The toilet 100 may further comprises a toilet lid 108, a toilet seat 110, and a toilet bowl 204. In some embodiments, the toilet seat 110 may further comprise a seat gasket 112. The seat gasket 112 is a seal that seals the gap between the toilet seat 110 and the toilet bowl 204 to help prevent odors from escaping into the air. The toilet may comprise at least one plumbing assembly, ideally being located within the toilet tank 150. The toilet tank 150 may be any shape or configuration well-known in the art, providing a space to house a plumbing assembly or retain water to allow for flushing of the toilet system. For example, the toilet tank 150 may comprise a standard water tank that stores water within the tank to allow for flushing. The plumbing assembly may be either a residential plumbing assembly 102 or a commercial plumbing assembly 104. The residential plumbing assembly 102 is adapted to connect to a residential water supply by exiting through the back of the toilet tank 150. As seen in FIG. 8, the commercial plumbing assembly 104 is adapted to connect to a commercial water supply by exiting through the bottom of the toilet tank 150. In either embodiment, the at least one plumbing assembly may be adapted to fill the toilet bowl 204 directly, avoiding the need to retain water within the toilet tank 150 itself. The plumbing assembly may be connected to a flush button 106, such that the plumbing assembly activates and pulls water to flush the toilet from the attached water supply when the push button is depressed. In some embodiments, the push button may comprise a traditional flushing mechanism, such as a lever, handle, or other flushing mechanism well-known in the art. As seen in FIG. 10, the toilet bowl 204 may further comprise at least one bowl refill vent 152 and at least one bowl odor vent 208.

The present invention further comprises a vacuum pump 148, as seen in FIG. 1. In the ideal embodiment, the vacuum pump 148 is a wet/dry vacuum pump 148 adapted to handle both liquids and gases. The vacuum pump 148 may be communicably connected to the first drainage tube 134 and the second drainage tube 136. The vacuum pump 148 may be powered by a battery 132. The battery 132 may further be connected to a relay. The relay 130 may be a motherboard or processing unit. The relay 130 may be adapted to manage the charging of the battery 132, and to manage the state of the toilet, such as by keeping track of the state of the toilet lid 108 and seat, and by managing the on/off state or suction level of the vacuum pump 148. In the ideal embodiment, a power cord 144 is further connected to the battery 132. The power cord 144 is adapted to plug into a wall power outlet or similar power source to receive power and allow the battery 132 to charge, or the power cord 144 may be directly electrically connected to other components to allow for direct powering if the battery 132 is removed.

The first drainage tube 134 may be communicably connected to the vacuum pump 148 at a first end of the first drainage tube 134. A second end of the first drainage tube 134 may be connected to the at least one bowl odor vent 208. In this configuration, when the vacuum pump 148 is activated, the at least one bowl odor vent 208 will create suction through the at least one bowl odor vent 208, and suck in air (and any contained odors) from within the toilet bowl 204. These odors will be transmitted into the first drainage tube 134.

To prevent odors from returning into the toilet bowl 204, the first drainage tube 134 may further comprise a water trap 200, as seen in FIG. 1. The water trap 200 is ideally designed as a u-shaped bend, wherein the bottom of the u-shaped bend is adapted to have a quantity of fluid. Thus, when the vacuum pump 148 is not activated, the water in the water trap 200 acts as a barrier to prevent gases from returning.

In some embodiments, the first drainage tube 134 may further comprise a trap bulb 202. The trap bulb 202 comprises a bulbous section added into the tube, as seen in FIG. 1. The water trap 200 bulb is adapted such that it breaks the suction from the vacuum. That is to say, when the fluid from the water trap 200 reaches the trap bulb 202, the suction will not be powerful enough to pull the fluid further than the trap bulb 202. This allows gases to be extracted from the first drainage tube 134, while the fluid may remain in the first drainage tube 134, even while the vacuum pump 148 is activated. When the vacuum pump 148 is deactivated, the fluid will settle back into the water trap 200 to block any fumes from reentering the first drainage tube 134. In some embodiments, the first drainage tube 134 may further comprise fill markers 156. The fill markers 156 may be visual markers located on the exterior of the water trap 200, allowing the user to clearly see whether the water trap 200 has enough fluid to function properly.

As seen in FIG. 1, in some embodiments, the first drainage tube 134 may further comprise at least one first drainage opening 135. The at least one first drainage opening 135 may further comprise a first removable cap 159. The drainage opening may be sealed by the first removable cap 159. The first drainage opening is adapted to give the user access to the first drainage tube 134, allowing a user access to the first drainage tube 134 to manually remove blockages, perform maintenance, refill the water trap 200, or make any other desired fixes or alterations.

As seen in FIG. 10, in some embodiments, the toilet bowl 204 may further comprise at least one bowl refill vent 152. The at least one bowl refill vent 152 may be communicably coupled with the plumbing system, such that when the toilet is flushed, an additional quantity of water is communicated into the water trap 200. This allows the water trap 200 to be automatically refilled each time the toilet is flushed, preventing the water trap 200 from being rendered useless as a result of evaporation or other forms of water loss, without the need for manual maintenance. In some embodiments, the water trap 200 portion of the first drainage tube 134 may be transparent to allow a user to easily gauge at a glance whether the fluid meets the fill line on the first drainage tube 134.

A second drainage tube 136 may further be communicably connected to the vacuum pump 148 and the first drainage tube 134 at a first opening of the second drainage tube 136. A second opening of the second drainage tube 136 may be communicably connected to a disposal point. The disposal point may be the sewer system or other suitable disposal point, such as the outdoors. The second drainage tube 136 is ideally connected opposite the first drainage tube 134. In this configuration, when the vacuum pump 148 is turned on, gases are sucked out through the first drainage tube 134, and communicated into the second drainage tube 136. The second drainage tube 136, being positioned on the opposite side of the vacuum pump 148, receives pressure and exhaust from the vacuum pump 148 instead of suction, further assisting in pushing any odors or gases into the disposal point.

Similar to the first drainage tube 134, the second drainage tube 136 may further comprise at least one second drainage tube 136 opening. The at least one second drainage tube 136 opening may be sealed a second removable cap. The second drainage opening is adapted to give the user access to the second drainage tube 136, allowing a user access to the second drainage tube 136 to manually remove blockages, perform maintenance, or make any other desired fixes or alterations.

In some embodiments, and as seen in FIGS. 1, 3, 6, and 9, the access area 158 may be located towards the rear of the toilet, near the base. The access area 158 is designed to house may of the components, such as the relay, battery 132, vacuum pump 148, first drainage tube 134, and second drainage tube 136 within one space. The access area 158 may further comprise an opening to allow a user to easily view and access the contained componentry. In one embodiment, the access area 158 may further comprise a removable access panel 162 that covers the opening of the access area 158. The removable access panel 162 may further comprise an access panel gasket 140 to help seal the access area 158 when the access panel 162 is in a closed positioned. At least one access panel fastener 142 may be used to secure the access panel 162 to the access area 158 opening. The at least one access panel fastener 142 may comprise any convention fasteners, such as screws, nuts, bolts, adhesive, or other removable fasteners well known in the art. The at least one access panel 162 may further comprise sound proofing 138 to help reduce the noise generated by the vacuum pump 148 and drainage tubes while the toilet is in use. The sound proofing 138 may be attached integral to the panel or may be detachably attached to the panel through any of the fastening means described above.

In some embodiments, the toilet 100 may further comprise an automated mechanism for opening and closing the toilet seat 110. In the ideal embodiment, this is done through the use of at least one momentary button 114 positioned beneath the toilet seat 110. In this configuration, the at least one momentary button 114 acts as a pressure sensor, allowing electrical current to flow to the vacuum pump 148 to activate the vacuum pump 148 when the at least one momentary button 114 is depressed. In this way, when a user is seated on the toilet seat 110, the momentary buttons will be depressed and the vacuum pump 148 will be activated for as long as the user is seated on the toilet. The at least one momentary button 114 may be electrically connected to the battery 132 for power, and may be electrically connected to the relay 130 to receive specific instruction or electric management from the relay. In some embodiments, the at least one momentary button 114 may be adapted to send a signal to the relay 130 to flush the toilet when the momentary button is released from the depressed position, such that the toilet automatically flushes when a user stands from the toilet seat 110.

In some embodiments, the toilet may further comprise a lighted push button 128. The lighted push button 128 is ideally located near the base of the toilet, such that a user may depress the button with their foot when they are standing near the toilet. The lighted push button 128 may be electrically connected to the battery 132 for power, and may be electrically connected to the relay 130 to receive specific instruction or electric management from the relay. In the ideal embodiment, the lighted push button 128 is electrically connected to at least one motor assembly.

The at least one motor assembly is ideally located within a seat mechanism housing 116 located towards the rear of the toilet seat 110. The at least one motor assembly may be electrically connected to the battery 132 for power, and may be electrically connected to the relay 130 to receive specific instruction or electric management from the relay. In the ideal embodiment, as seen in FIG. 1, the at least one motor assembly may comprise a first motor assembly 120 functionally connected to be able to provide force to raise one side of the toilet seat 110 and lid, and a second motor assembly 122 functionally connected to be able to provide force to raise the other side of the toilet seat 110 and toilet lid 108.

In the ideal embodiment, the lighted push button 128 is electrically connected to at least one motor assembly. The seat mechanism housing 116 provides space for at least one motor assembly to be housed within it, having at least one opening. The at least one opening of the seat mechanism housing 116 may be covered by a removable housing end cap 118. The at least one motor assembly may be functionally connected to the toilet seat 110 and toilet lid 108, such that when the motor assembly is activated, it may either raise or lower the toilet seat 110 and/or the toilet lid 108 selectively depending on the instruction received from the relay. For example, if the lid and seat begin in a closed position, the lid may be raised on a first press of the lighted push button 128, and the seat may be raised on a second press. In some embodiments, the at least one motor assembly may be adapted to close the toilet seat 110 and/or lid after a certain period of time has elapsed, as calculated by the relay.

In some embodiments, the seat mechanism housing 116 may further comprise a lighted lens. The lighted lens may be electrically connected to the battery 132 for power, and may be electrically connected to the relay 130 to receive specific instruction or electric management from the relay. The lighted lens may comprise a light or colored light, such as a colored LED, and may be adapted to produce light or change colors based on the status of the motor, allowing the lighted lens to indicated, for example, whether the at least one motor assembly has power or the at least one motor assembly is in an errored state.

Figure 2:
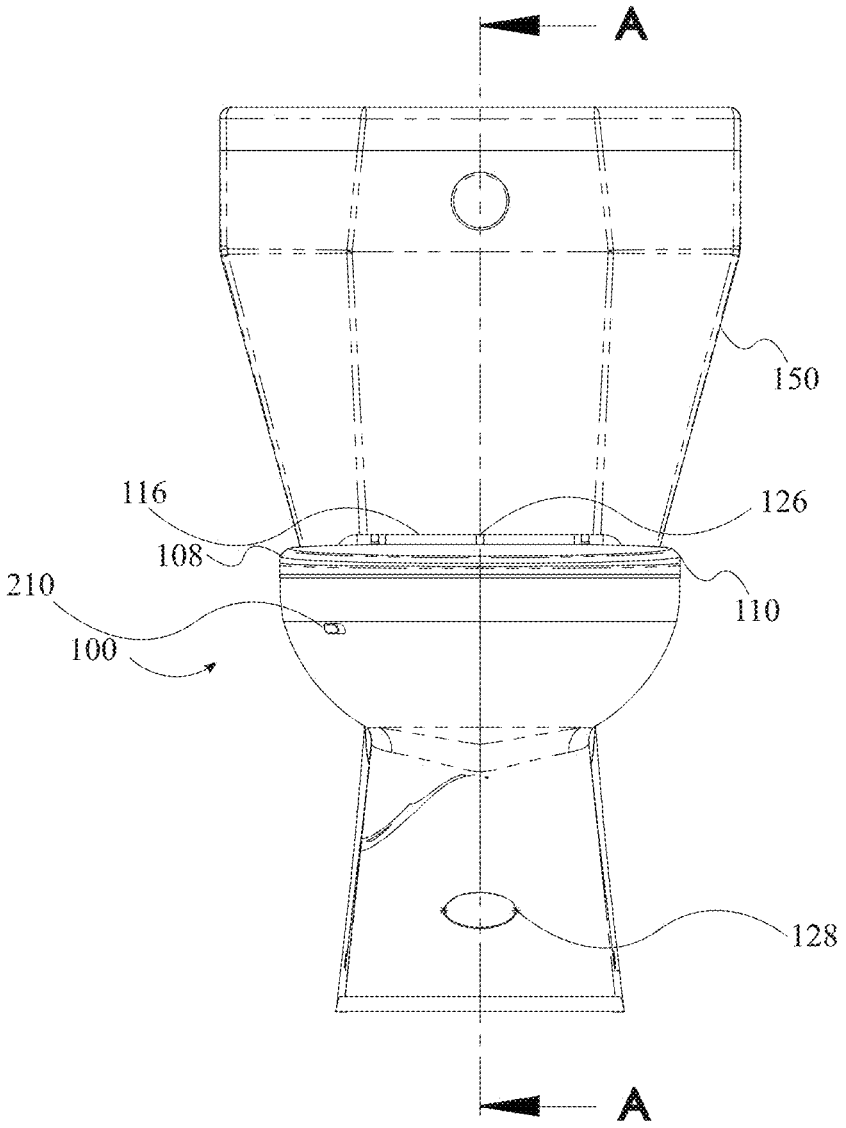
FIG. 2 shows a front view of the present invention.
Figure 3:
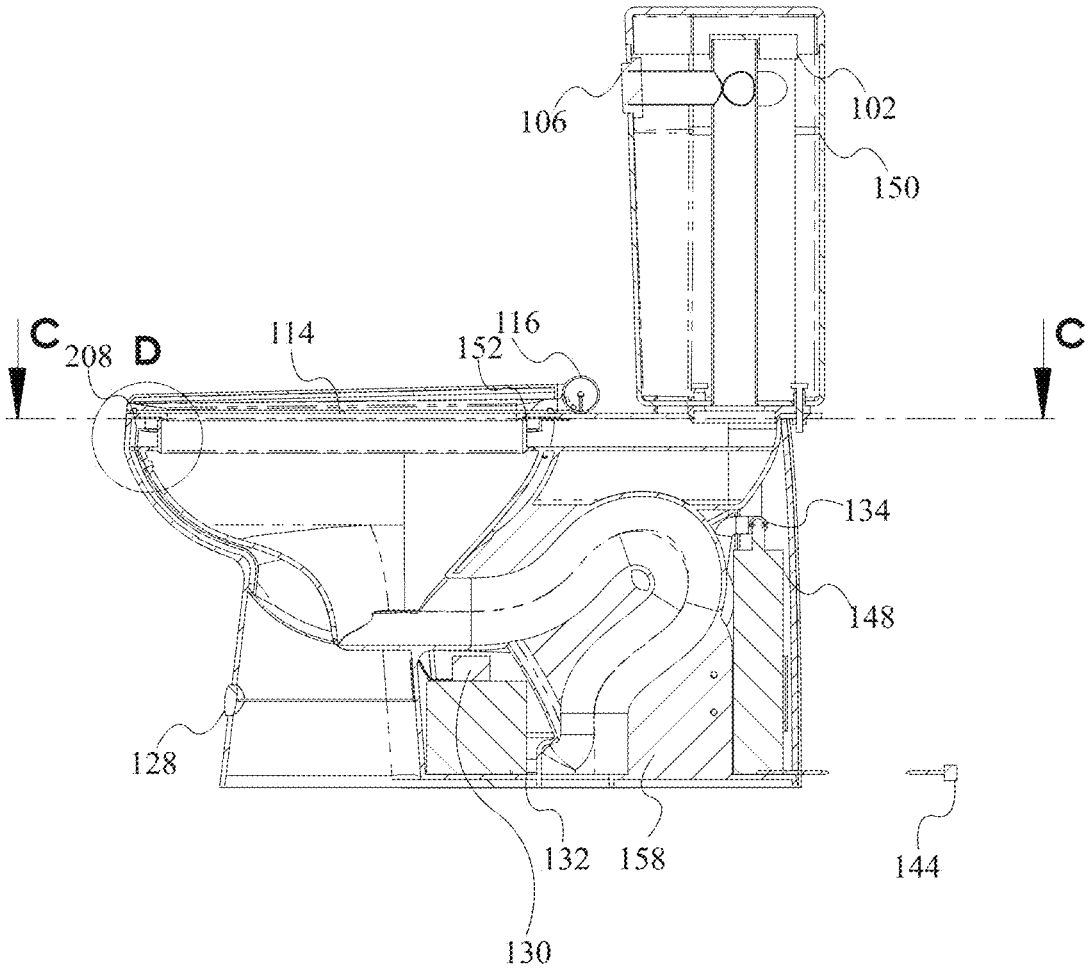
FIG. 3 shows a cross-sectional view of FIG. 2 taken along line A-A.
Figure 4:
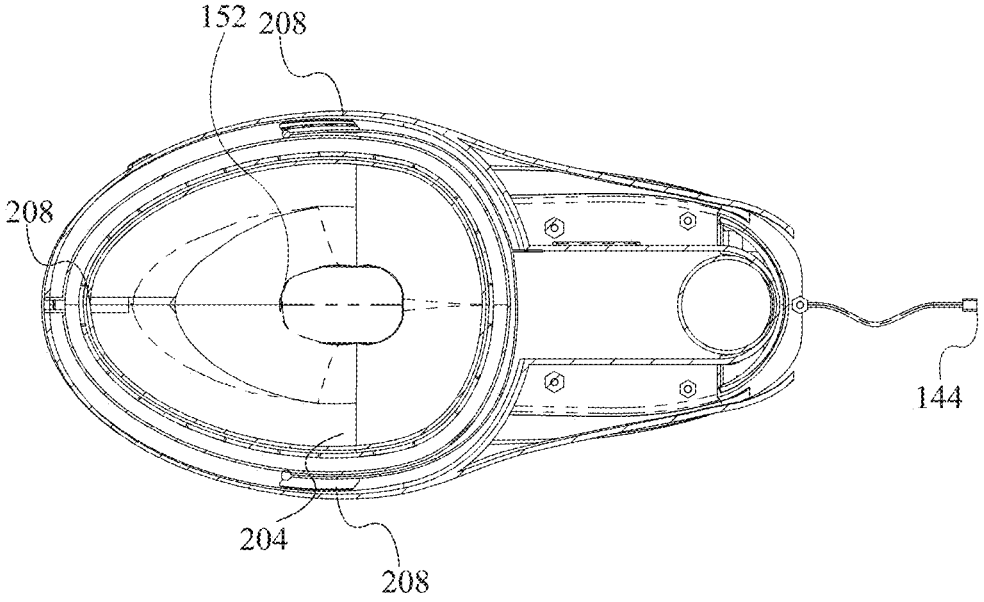
FIG. 4 shows a cross-sectional view of FIG. 3 taken along line C-C.
Figure 5:
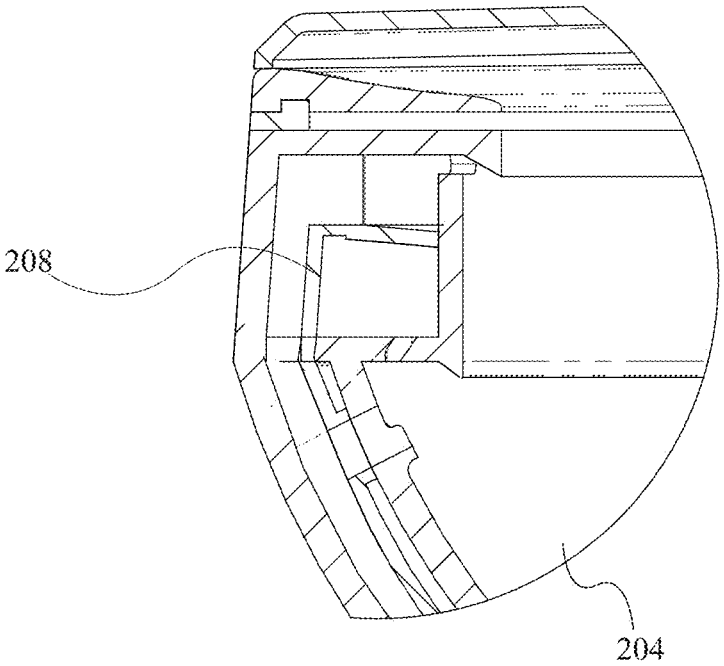
FIG. 5 shows an enlarged view of section D of FIG. 3.
Figure 6:
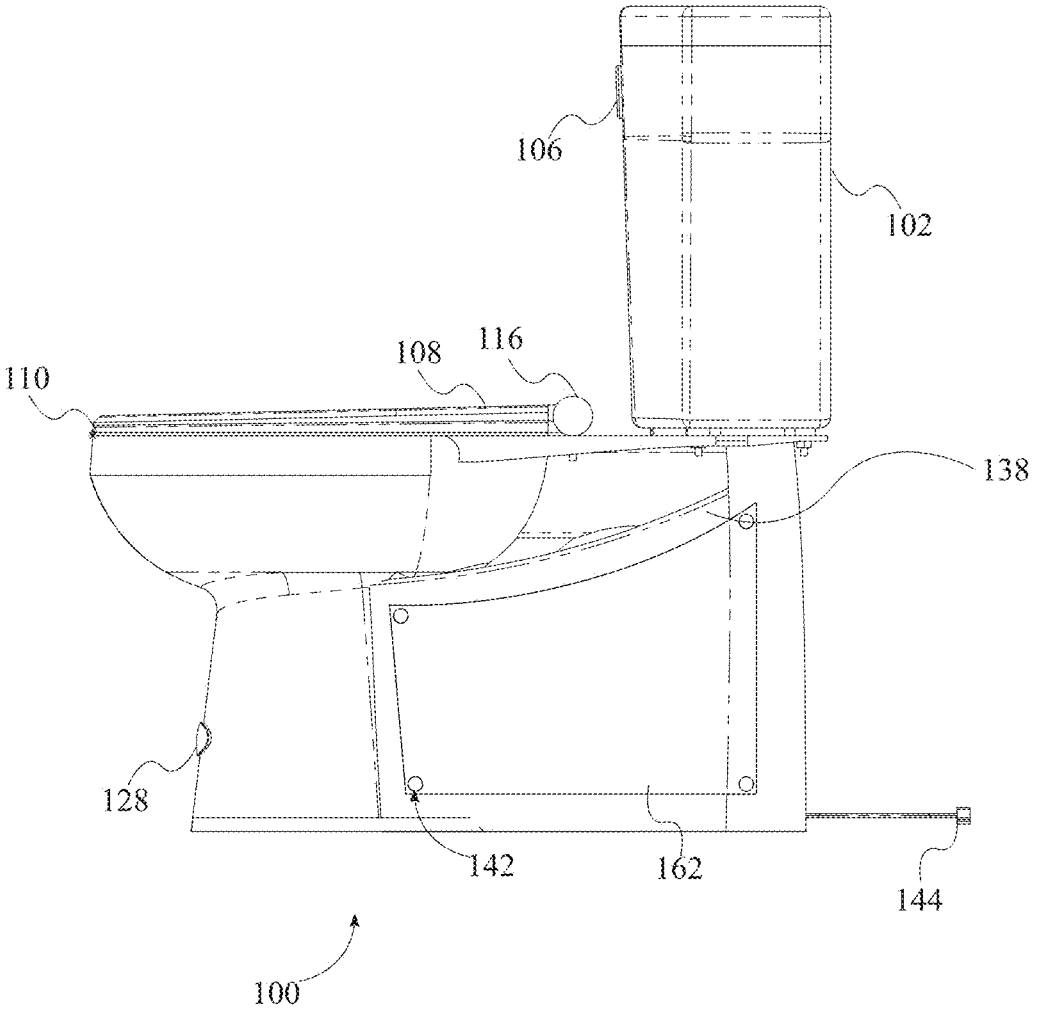
FIG. 6 shows a side view of the present invention.
Figure 7:
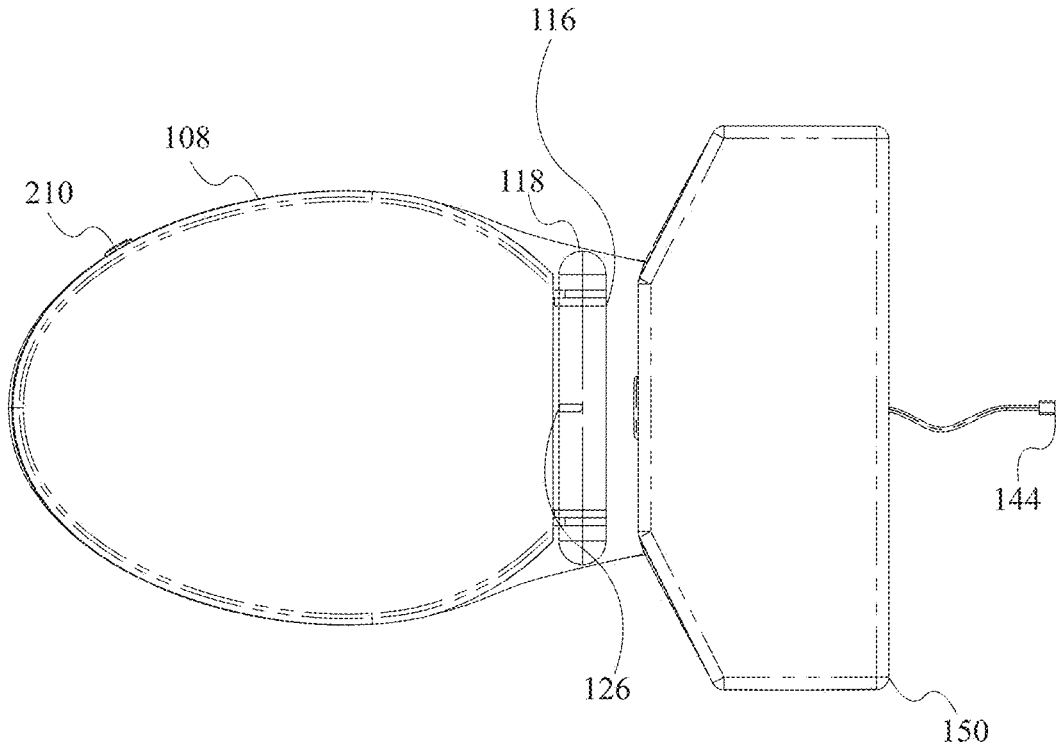
FIG. 7 shows a top-down view of the present invention.

In some embodiments, as seen in FIGS. 1-2, the toilet may further comprise a backup button 210. The backup button 210 may be electrically connected to the battery 132 for power, and may be electrically connected to the relay 130 to receive specific instruction or electric management from the relay, or the backup button 210 may be directly electrically connected to the vacuum pump 148. The backup button 210 is configured to turn the vacuum pump 148 on and off directly, allowing a user to have more control over when the vacuum pump 148 is running, and to prevent the vacuum pump 148 from being stuck in an "on" position in the event of an error.

Although the invention has been explained in relation to its preferred embodiment, it is to be understood that many other possible modifications and variations can be made without departing from the spirit and scope of the invention.

I claim:

1. A toilet vacuum system comprising:
- a toilet;
- a plumbing assembly;
- a flush button;
- a first drainage tube;
- a vacuum pump;
- wherein the toilet further comprises a toilet seat, a toilet lid, a toilet bowl, and a toilet tank;
- wherein the toilet bowl further comprises at least one bowl odor vent;
- wherein the at least one bowl odor vent is communicably coupled with the first drainage tube;
- wherein the first drainage tube is communicably connected to a vacuum pump, such that when the vacuum pump is activated, the first drainage tube creates suction through the at least one bowl odor vent;
- the first drainage tube further comprising a water trap;
- the water trap further being transparent;
- the water trap further comprising at least one fill marker,
- the water trap further comprising a trap bulb;
- wherein the fill marker is positioned to indicate a recommended amount of water in the water trap; and
- wherein the trap bulb is configured in a bulbous shape to prevent water from escaping the bulb when the vacuum is in an active state.

2. The toilet vacuum system of claim 1, further comprising:
- at least one bowl refill vent;
- the at least one bowl refill vent being communicably coupled with the plumbing assembly;
- wherein the at least one bowl refill vent is communicably coupled with the first drainage tube; and
- wherein the at least one bowl refill vent is adapted to receive a quantity of fluid from the first plumbing assembly upon the flushing of the toilet and transmit the quantity of fluid into the water trap.

3. The toilet vacuum system of claim 1, further comprising:
- the plumbing assembly comprising a residential plumbing assembly,
- wherein the residential plumbing assembly is fastened within the toilet tank; and
- wherein the plumbing assembly is adapted to connect to a residential water source through the rear of the toilet tank.

4. The toilet vacuum system of claim 1, further comprising:
- the plumbing assembly comprising a commercial plumbing assembly;
- wherein the commercial plumbing assembly is fastened within the toilet tank; and
- wherein the commercial plumbing assembly is adapted to connect to a commercial water source through the bottom of the toilet tank.

5. The toilet vacuum system of claim 1, further comprising:
- a seat gasket fastened beneath the toilet seat,
- a seat mechanism housing;
- a lighted push button;
- the seat mechanism housing further comprising at least one housing end cap;
- at least one motor assembly;

wherein the at least one motor assembly is contained within the seat mechanism housing; and wherein the lighted push button is electrically connected to the at least one motor assembly, such that when the lighted push button is depressed, the toilet seat and toilet lid change between the raised and lowered positions.

6. The toilet vacuum system of claim 5, further comprising:

a battery;

a relay;

wherein the battery is electrically coupled to the relay to provide power to the relay;

wherein the relay is electrically coupled to the lighted push button;

wherein the relay is electrically coupled to the vacuum pump;

wherein the relay is configured to manage the state of the battery;

wherein the relay is configured to manage the state of the toilet seat and lid through the lighted push button; and wherein the seat mechanism housing further comprises a light lens.

7. The toilet vacuum system of claim 5, further comprising:

a power cord;

the power cord being adapted to connect to the battery;

wherein the battery is a rechargeable battery; and wherein the battery is adapted to recharge from current provided through the power cord.

8. The toilet vacuum system of claim 1, further comprising:

at least one momentary button;

the at least one momentary button being positioned beneath the toilet seat;

the at least one momentary button being electrically coupled to the at least one vacuum pump; and wherein the vacuum pump is adapted to turn on when the momentary button is in a depressed state.

9. The toilet vacuum system of claim 1, further comprising:

a second drainage tube having at least one second drainage tube opening;

the second drainage tube being communicably coupled with the first drainage tube; and wherein the one second drainage tube is communicably coupled with a disposal point.

10. The toilet vacuum system of claim 9, further comprising:

the first drainage tube having at least one first drainage tube opening;

the second drainage tube having at least one second drainage tube opening;

wherein the at least one first drainage tube opening is configured with a first removable cap; and wherein the at least one second drainage tube opening is configured with a second removable cap.

11. The toilet vacuum system of claim 1, further comprising:

an access area;

the access area further comprising an access panel;

the access panel further comprising at least one access panel fastener;

the access panel further comprising an access panel gasket;

the access panel further comprising sound proofing;

wherein the access panel is removably coupled to the toilet by the at least one access panel fastener;

wherein the sound proofing is coupled to the access panel.

12. The toilet vacuum system of claim 1, further comprising:

a backup button;

wherein the backup button is electrically connected to the vacuum pump; and wherein the backup button is adapted to turn on and off the vacuum pump when pressed.

13. A toilet vacuum system comprising:

a toilet;

a plumbing assembly;

a flush button;

a first drainage tube;

a vacuum pump;

a battery;

a relay;

wherein the toilet further comprises a toilet seat, a toilet lid, a toilet bowl, and a toilet tank;

wherein the toilet bowl further comprises at least one bowl odor vent;

wherein the at least one bowl odor vent is communicably coupled with the first drainage tube;

wherein the first drainage tube is communicably connected to a vacuum pump, such that when the vacuum pump is activated, the first drainage tube creates suction through the at least one bowl odor vent;

the first drainage tube further comprising a water trap;

the water trap further being transparent;

the water trap further comprising at least one fill marker;

the water trap further comprising a trap bulb;

wherein the fill marker is positioned to indicate a recommended amount of water in the water trap;

wherein the trap bulb is configured in a bulbous shape to prevent water from escaping the bulb when the vacuum is in an active state;

at least one bowl refill vent;

the at least one bowl refill vent being communicably coupled with the plumbing assembly;

wherein the at least one bowl refill vent is communicably coupled with the first drainage tube;

wherein the at least one bowl refill vent is adapted to receive a quantity of fluid from the first plumbing assembly upon the flushing of the toilet and transmit the quantity of fluid into the water trap;

a seat gasket fastened beneath the toilet seat, a seat mechanism housing;

a lighted push button;

the seat mechanism housing further comprising at least one housing end cap;

at least one motor assembly;

wherein the at least one motor assembly is contained within the seat mechanism housing;

wherein the lighted push button is electrically connected to the at least one motor assembly, such that when the lighted push button is depressed, the toilet seat and toilet lid change between the raised and lowered positions;

a power cord;

the power cord being adapted to connect to the battery;

wherein the battery is a rechargeable battery;

wherein the battery is adapted to recharge from current provided through the power cord;

a second drainage tube having at least one second drainage tube opening;

the second drainage tube being communicably coupled with the first drainage tube;

wherein the one second drainage tube is communicably coupled with a disposal point;

the first drainage tube having at least one first drainage tube opening;

the second drainage tube having at least one second drainage tube opening;

wherein the at least one first drainage tube opening is configured with a first removable cap;

wherein the at least one second drainage tube opening is configured with a second removable cap;

wherein the battery is electrically coupled to the relay to provide power to the relay;

wherein the relay is electrically coupled to the lighted push button;

wherein the relay is electrically coupled to the vacuum pump;

wherein the relay is configured to manage the state of the battery;

wherein the relay is configured to manage the state of the toilet seat and lid through the lighted push button; and wherein the seat mechanism housing further comprises a light lens.

14. The toilet vacuum system of claim 13, further comprising:

the plumbing assembly comprising a residential plumbing assembly, wherein the residential plumbing assembly is fastened within the toilet tank; and wherein the plumbing assembly is adapted to connect to a residential water source through the rear of the toilet tank.

15. The toilet vacuum system of claim 13, further comprising:

the plumbing assembly comprising a commercial plumbing assembly;

wherein the commercial plumbing assembly is fastened within the toilet tank; and wherein the commercial plumbing assembly is adapted to connect to a commercial water source through the bottom of the toilet tank.

16. The toilet vacuum system of claim 13, further comprising:

at least one momentary button;

the at least one momentary button being positioned beneath the toilet seat;

the at least one momentary button being electrically coupled to the at least one vacuum pump; and wherein the vacuum pump is adapted to turn on when the momentary button is in a depressed state.

17. The toilet vacuum system of claim 13, further comprising:

an access area;

the access area further comprising an access panel;

the access panel further comprising at least one access panel fastener;

the access panel further comprising an access panel gasket;

the access panel further comprising sound proofing;

wherein the access panel is removably coupled to the toilet by the at least one access panel fastener; and wherein the sound proofing is coupled to the access panel.

18. A toilet vacuum system comprising:

a toilet;

a plumbing assembly;

a flush button;

a first drainage tube;

a vacuum pump;

a battery;

a relay;

wherein the toilet further comprises a toilet seat, a toilet lid, a toilet bowl, and a toilet tank;

wherein the toilet bowl further comprises at least one bowl odor vent;

wherein the at least one bowl odor vent is communicably coupled with the first drainage tube;

wherein the first drainage tube is communicably connected to a vacuum pump, such that when the vacuum pump is activated, the first drainage tube creates suction through the at least one bowl odor vent;

the first drainage tube further comprising a water trap;

the water trap further being transparent;

the water trap further comprising at least one fill marker;

the water trap further comprising a trap bulb;

wherein the fill marker is positioned to indicate a recommended amount of water in the water trap;

wherein the trap bulb is configured in a bulbous shape to prevent water from escaping the bulb when the vacuum is in an active state;

at least one bowl refill vent;

the at least one bowl refill vent being communicably coupled with the plumbing assembly;

wherein the at least one bowl refill vent is communicably coupled with the first drainage tube;

wherein the at least one bowl refill vent is adapted to receive a quantity of fluid from the first plumbing assembly upon the flushing of the toilet and transmit the quantity of fluid into the water trap;

a seat gasket fastened beneath the toilet seat, a seat mechanism housing;

a lighted push button;

the seat mechanism housing further comprising at least one housing end cap;

at least one motor assembly;

wherein the at least one motor assembly is contained within the seat mechanism housing;

wherein the lighted push button is electrically connected to the at least one motor assembly, such that when the lighted push button is depressed, the toilet seat and toilet lid change between the raised and lowered positions;

a power cord;

the power cord being adapted to connect to the battery;

wherein the battery is a rechargeable battery;

wherein the battery is adapted to recharge from current provided through the power cord;

a second drainage tube having at least one second drainage tube opening;

the second drainage tube being communicably coupled with the first drainage tube;

wherein the one second drainage tube is communicably coupled with a disposal point;

the first drainage tube having at least one first drainage tube opening;

the second drainage tube having at least one second drainage tube opening;

wherein the at least one first drainage tube opening is configured with a first removable cap;

wherein the at least one second drainage tube opening is configured with a second removable cap;

wherein the battery is electrically coupled to the relay to provide power to the relay;

wherein the relay is electrically coupled to the lighted push button;

wherein the relay is electrically coupled to the vacuum pump;

wherein the relay is configured to manage the state of the battery;

wherein the relay is configured to manage the state of the toilet seat and lid through the lighted push button;

wherein the seat mechanism housing further comprises a light lens;

at least one momentary button;

the at least one momentary button being positioned beneath the toilet seat;

the at least one momentary button being electrically coupled to the at least one vacuum pump;

wherein the vacuum pump is adapted to turn on when the momentary button is in a depressed state;

an access area;

the access area further comprising an access panel;

the access panel further comprising at least one access panel fastener;

the access panel further comprising an access panel gasket;

the access panel further comprising sound proofing;

wherein the access panel is removably coupled to the toilet by the at least one access panel fastener; and wherein the sound proofing is coupled to the access panel.

* * * * *